US012582268B2

(12) United States Patent
Mantenuto

(10) Patent No.: US 12,582,268 B2
(45) Date of Patent: Mar. 24, 2026

(54) NESTABLE AND DRAINABLE SHOWER NICHE INSERT SYSTEM

(71) Applicant: 2721111 ONTARIO INC., Vaughan (CA)

(72) Inventor: Paolo Mantenuto, Vaughan (CA)

(73) Assignee: 2721111 Ontario Inc., Ontario (CA)

( * ) Notice: Subject to any disclaimer, the term of this patent is extended or adjusted under 35 U.S.C. 154(b) by 556 days.

(21) Appl. No.: 17/999,857

(22) PCT Filed: Jun. 22, 2020

(86) PCT No.: PCT/CA2020/050867
§ 371 (c)(1),
(2) Date: Nov. 24, 2022

(87) PCT Pub. No.: WO2021/258181
PCT Pub. Date: Dec. 30, 2021

(65) Prior Publication Data
US 2023/0210314 A1 Jul. 6, 2023

(51) Int. Cl.
*A47K 3/28* (2006.01)
*A47B 81/00* (2006.01)

(52) U.S. Cl.
CPC ..... *A47K 3/281* (2013.01); *A47B 81/002* (2013.01)

(58) Field of Classification Search
CPC ..... A47B 2067/025; A47B 67/00–04; A47B 81/00; A47B 81/02; A47K 3/281; A47K 5/02; E04F 19/08–086
See application file for complete search history.

(56) References Cited

U.S. PATENT DOCUMENTS 1,305,918 A * 6/1919 May ..... A47K 5/02 312/351
1,376,239 A * 4/1921 Williamson ..... A47K 5/02 312/351
5,241,715 A * 9/1993 Duvall ..... A47K 3/281 4/596
5,401,094 A * 3/1995 Walsten ..... A47B 96/00 312/245
5,405,196 A * 4/1995 Shoup ..... A47B 57/42 312/351
5,954,411 A * 9/1999 Katz ..... A47B 67/02 312/224
8,585,162 B2 * 11/2013 Pantoja ..... A47K 3/281 312/248
9,770,137 B2 * 9/2017 Berke ..... A47B 67/02
10,165,904 B2 * 1/2019 Biagi ..... A47K 3/281
(Continued)

FOREIGN PATENT DOCUMENTS

EP 3248522 * 11/2017 ..... E04F 19/083
EP 3248522 A1 11/2017

*Primary Examiner* — David P Angwin
*Assistant Examiner* — Nicholas A Ros
(74) *Attorney, Agent, or Firm* — DLA Piper LLP (US)

(57) ABSTRACT

The nestable and drainable shower niche insert system inserts vertically and is retained within a shower stall. The system includes a water-tight pan having outwardly sloped walls, to insert and retain within and against the shower stall, and a nest pan retained within the water-tight pan. The nest pan has at least one horizontal wall adjacent one of the outwardly sloped walls, to guide and drain liquid running off the horizontal wall into the shower stall.

7 Claims, 7 Drawing Sheets

(56) References Cited

U.S. PATENT DOCUMENTS

| | | | | |
|---|---|---|---|---|
| 2014/0231298 | A1* | 8/2014 | DiCianni | A47K 3/281<br>206/509 |
| 2015/0366342 | A1* | 12/2015 | Cohen | A47B 81/002<br>108/42 |
| 2018/0235366 | A1* | 8/2018 | Pyle | A47B 67/02 |

* cited by examiner

NESTABLE AND DRAINABLE SHOWER NICHE INSERT SYSTEM

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention is in the field of bathing and showering stalls, and more specifically niche inserts for use in bathing and showering stalls.

2. Description of Related Art Including Information Disclosed Under 37 CFR 1.97 and 37 CFR 1.98

This description showering stalls are considered no different than bathing stalls in that both typically have a standing or sitting area to bathe/shower, an ability to transport and disperse water within the stall, and at least three walls forming the stall.

Bathing and showering stalls of varying types are well known, and the present invention applies to any of those types of stalls, accounting for varying methods of conventional (non-inventive) installation.

In any residential washroom or bathroom, a bathtub/shower combination is likewise considered a bathing and showering stall in that same has a standing and sitting area to bathe/shower, an ability to transport and disperse water within the stall, and at least three walls to form the stall.

In bathing or showering, users typically want a place to store or rest items such as shampoo bottles, soap bars, razors, and the like.

Where no shelves are present or installed within the stall, users are forced to leave their various items either on a tub edge (hoping that same will not slip into the tub), or otherwise on the tub/stall ground, which is not hygienic.

Where bottles and soaps are stored atop tubs or shelves, drainage is poor and tends to pool underneath bottles and soaps in particular.

Stagnant and pooled water (resulting from poor drainage) leads to hard water scaling and deposits, bacterial growth, and in extreme cases fungus and mould.

Also, drainage from tub edges and shelves is poor particularly because those tub edges and shelves are horizontal (in relation to ground level) in order to support bottles, soaps, razors, etc. atop of same.

Additionally, people have a preference to not store bottles and soaps etc. atop tub edges and shelves but instead maintain a "clean" appearance in a tub or stall by hiding such items from open view.

At present there is no practical way to maintain easy access to items like bottles and soaps etc. in a stall while simultaneously hiding same from open or even recognizable view, especially when trying to account for draining problems.

BRIEF SUMMARY OF THE INVENTION

The present invention is a nestable and drainable shower niche insert system for inserting vertically and retaining within a shower stall.

The insert system comprises a water-tight pan having outwardly sloped walls, and a nest pan nested within the water-tight pan.

DETAILED DESCRIPTION OF THE INVENTION

The present invention comprises nestable and drainable shower niche insert system (10) for inserting vertically and retaining within a shower stall (20), as shown generally throughout FIGS. 1 to 6.

The insert system is comprised of at least two parts, namely a water-tight pan (30) and a nest pan (40).

The water-tight pan (30) is shaped and designed to insert and retain within and against the shower stall (20).

Generally and in terms of practicality, the water-tight pan (30) and the nest pan (40) will be of a square/quadrilateral configuration, to deal with the reality of what lies behind many stall (20) walls, namely anything from standard-spaced joists and beams to concrete to nothing at all.

As such, FIGS. 1 to 6 show the most realistic or practical configuration of the niche insert system (10) generally, however, an endless variety of shapes and configurations can be made regardless of practicality or difficulty in manufacture, so long as the niche insert system (10) is made consistent with the inventive steps herein.

Generally for market reasons it will be desirable that the niche insert system (10) is largely quadrilateral or square/rectangular prism, especially for the sake of appeal to the home renovation industry where issues like spaced apart wall studs must be dealt with.

Figure 7:
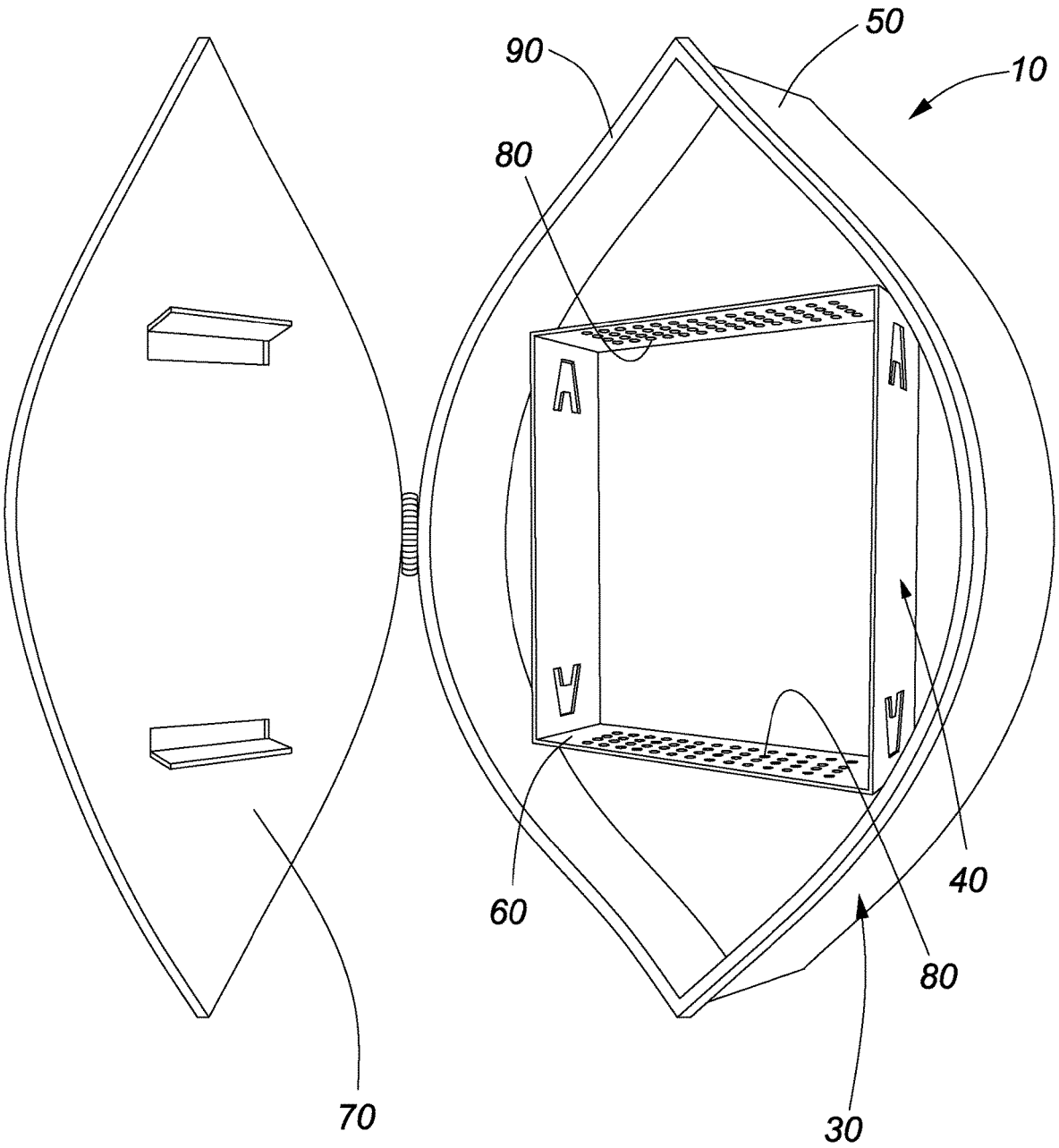
FIG. 7 is a perspective view of an alternately shaped embodiment of the nestable and drainable niche insert.

For example, FIG. 7 shows a largely impractical albeit possible alternate configuration for the present shower niche insert system (10), that otherwise functions consistently with the following principles.

The water-tight pan (30) has outwardly sloped walls (50), and as such when the water-tight pan (30) is installed (regardless of orientation), the bottom-most facing such outwardly sloped wall (50) results in gravitational liquid drainage downward and away from the water-tight pan (30) into the shower stall.

While the outwardly sloped walls (50) solve the problem of liquid drainage, in order to be able to nest bottles (not shown), soaps (not shown), and the like (not shown), a flat (relative to ground level) surface is required.

Therefore, the system provides a second pan, namely the nest pan (40), that is retained and nested within the water-tight pan (30) such that the placement of the nest pan (40) within the water-tight pan (30) defines a circumscribing gap therearound and between the water-tight pan (30) and the nest pan (40).

The circumscribing gap running between the water-tight pan (30) and the nest pan (40) facilitates liquid drainage out the insert system (10) and into the stall (20), even though the niche insert system (10) is buried within the stall (20) wall such that the niche insert system lies co-planar to the stall (20) wall.

The nest pan (40) has at least one wall (60) horizontal to ground level, that acts as a shelf for resting selected items (like bottles, soaps, etc.-all not shown) thereupon. The horizontal wall (ie the shelf) (60) is adjacent one of the outwardly sloped walls (50), such that liquid running off bottles, soap, etc. (not shown), onto the shelf (60) eventually spill over onto and follow down along the sloped wall (50) such that the liquid is guided and drained away from the water-tight pan (30) and into the shower stall (20).

To optimize drainage off the shelf (60), the shelf (60) defines a plurality of openings (80) thereon, for easy liquid passage therethrough.

The openings (80) can be not only liberally dispersed throughout the nest pan (40) shelf (60) but throughout other portions of the nest pan, so as to accelerate drying via increased liquid drainage away from the nest pan (40).

In an ultimate configuration where the niche insert system (10) is meant to be nearly invisible (ie co-planar) but also merge with any decorative aspect (eg tiling) within a shower stall (20), it is preferable in particular that the nest pan (30) is countersunk relative to the water-tight pan (20).

By counter-sinking the nest pan (30), the insert system (10) can further include a swinging door (70) and yet upon installation still be co-planar with a shower stall (20) wall (ie "invisible" or minimalist in appearance).

Figure 1:
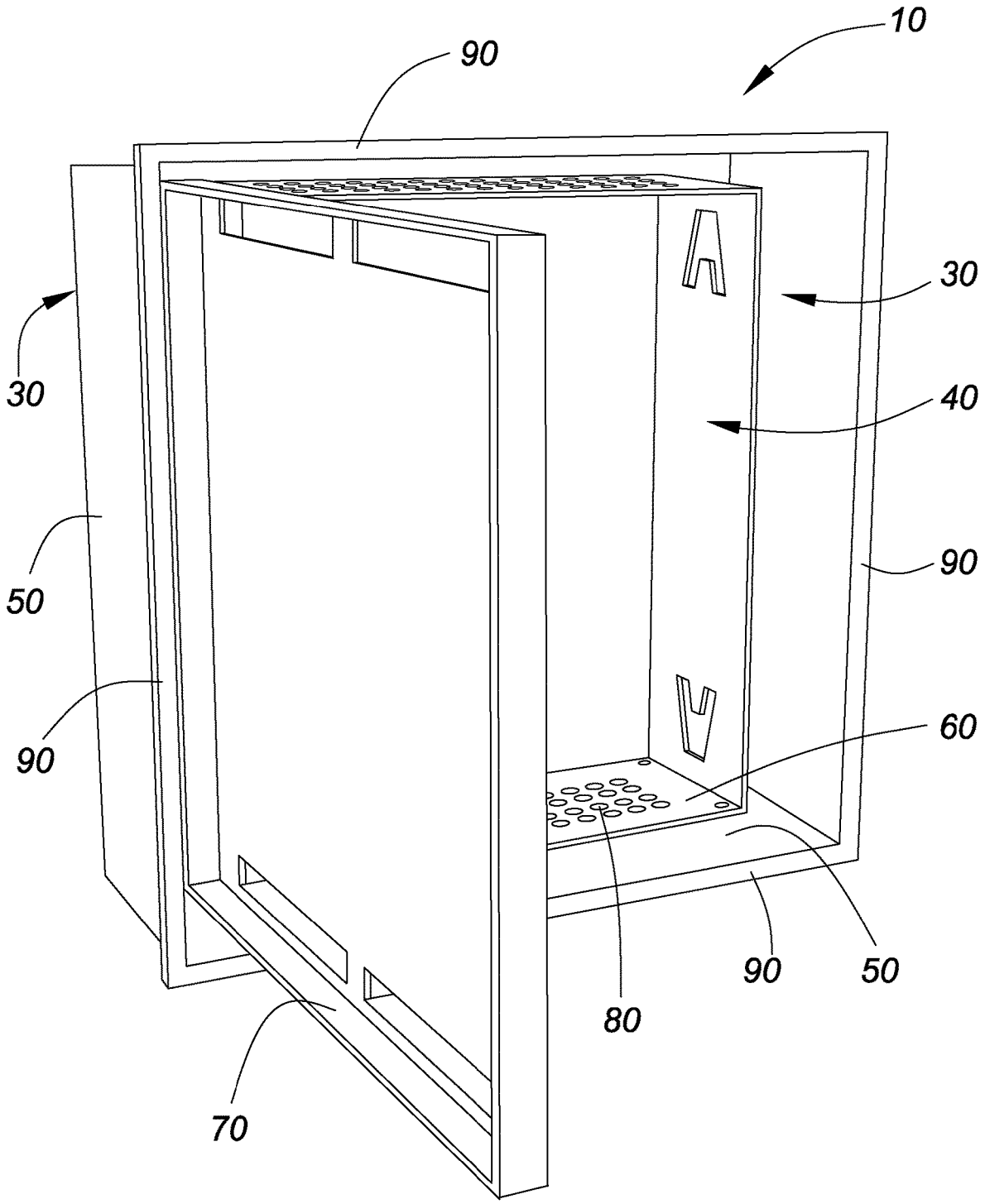
FIG. 1 is a perspective view of a nestable and drainable niche insert.
Figure 2:
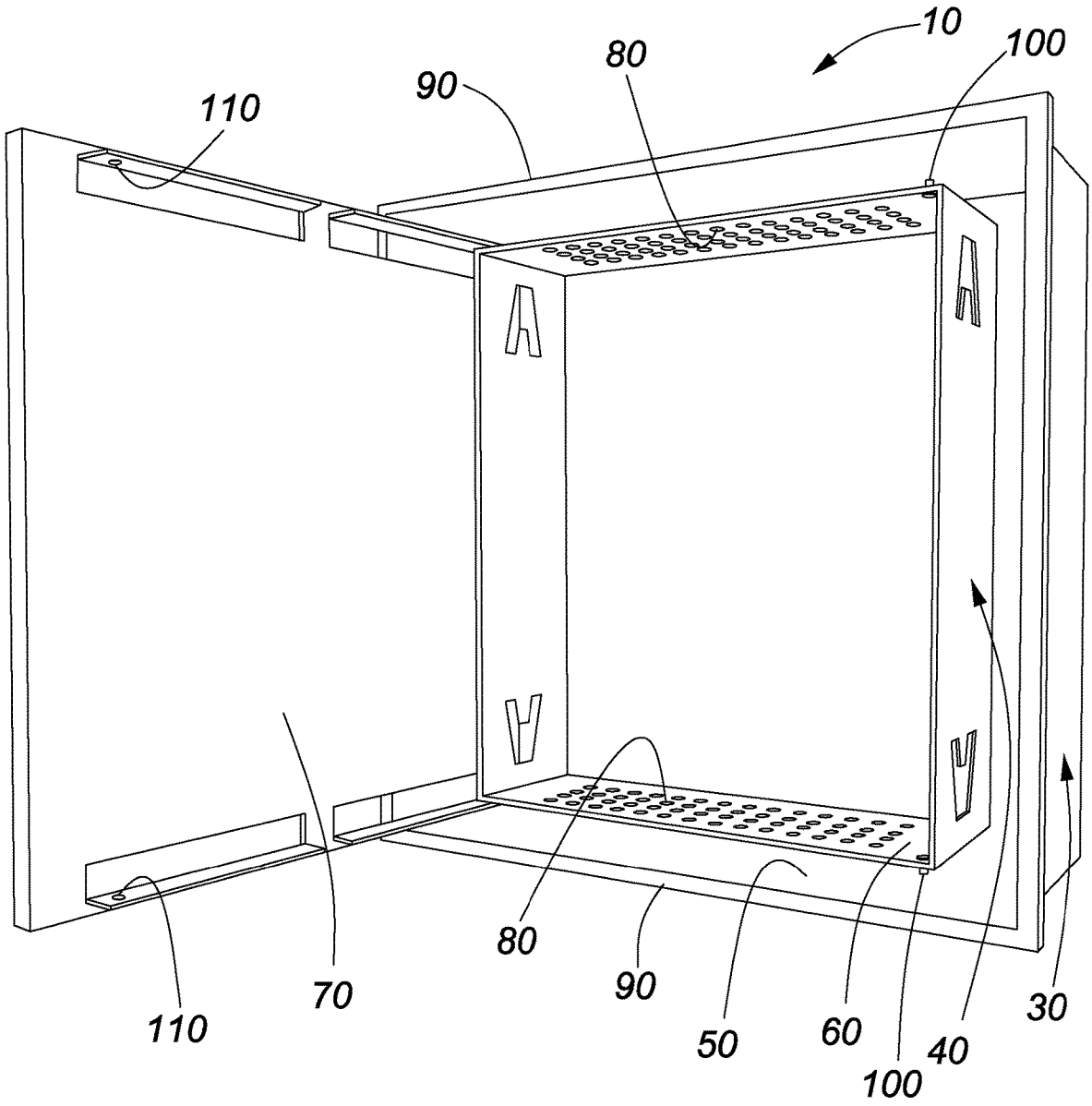
FIG. 2 is another perspective view of the nestable and drainable niche insert.
Figure 3:
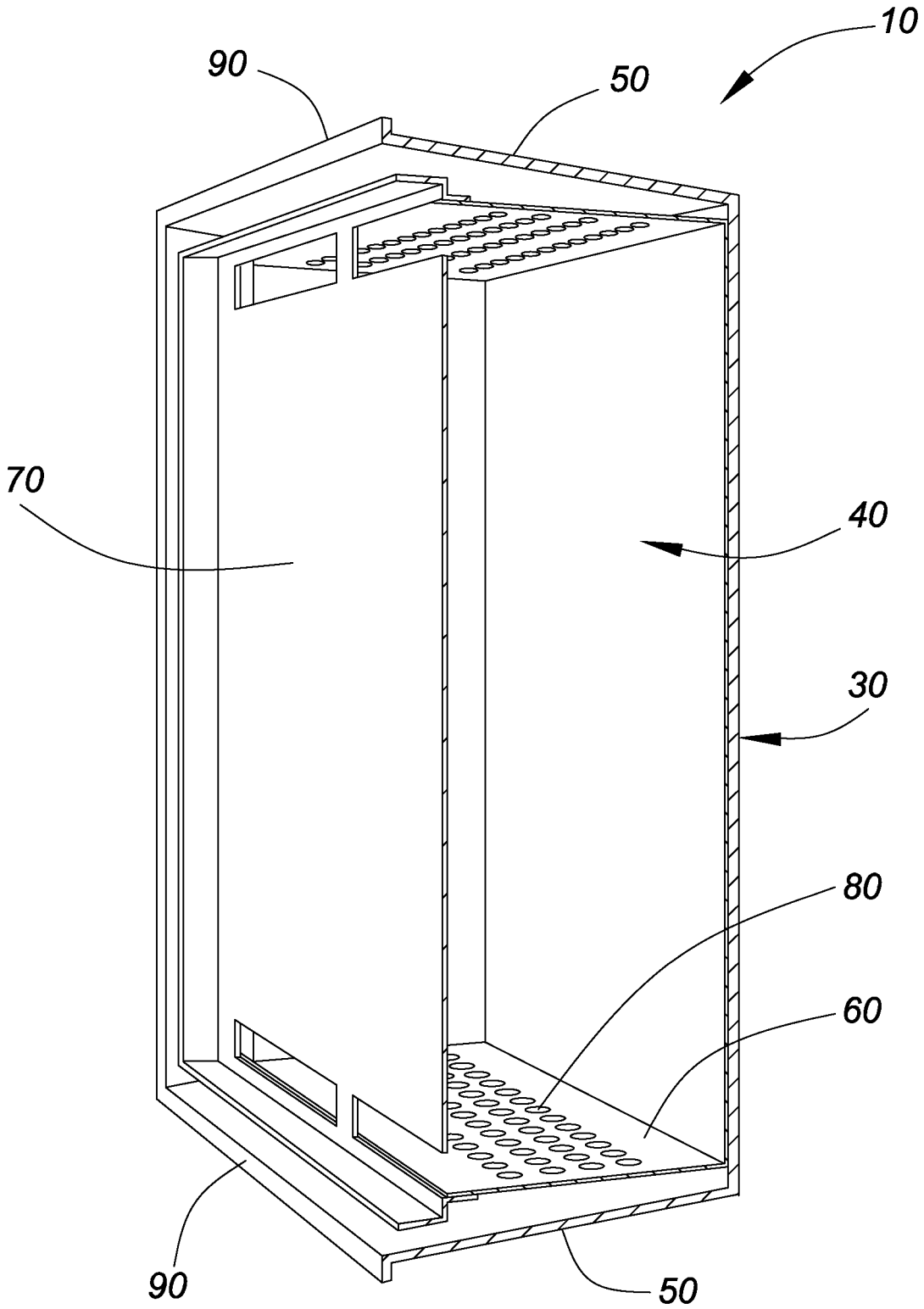
FIG. 3 is another perspective view with partial cross-section view of the nestable and drainable niche insert.
Figure 4:
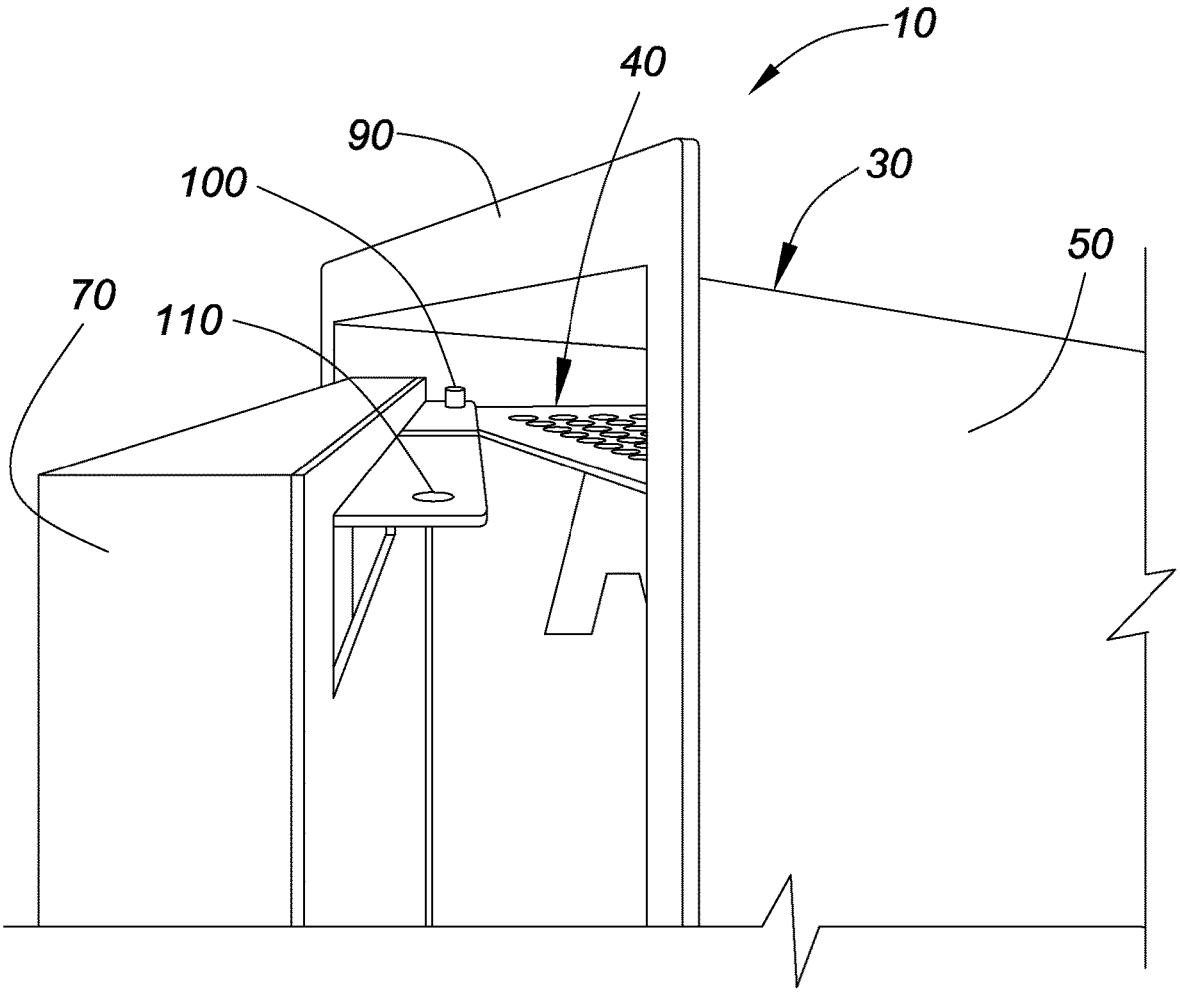
FIG. 4 is an enlarged partial perspective view of the nestable and drainable niche insert.
Figure 5:
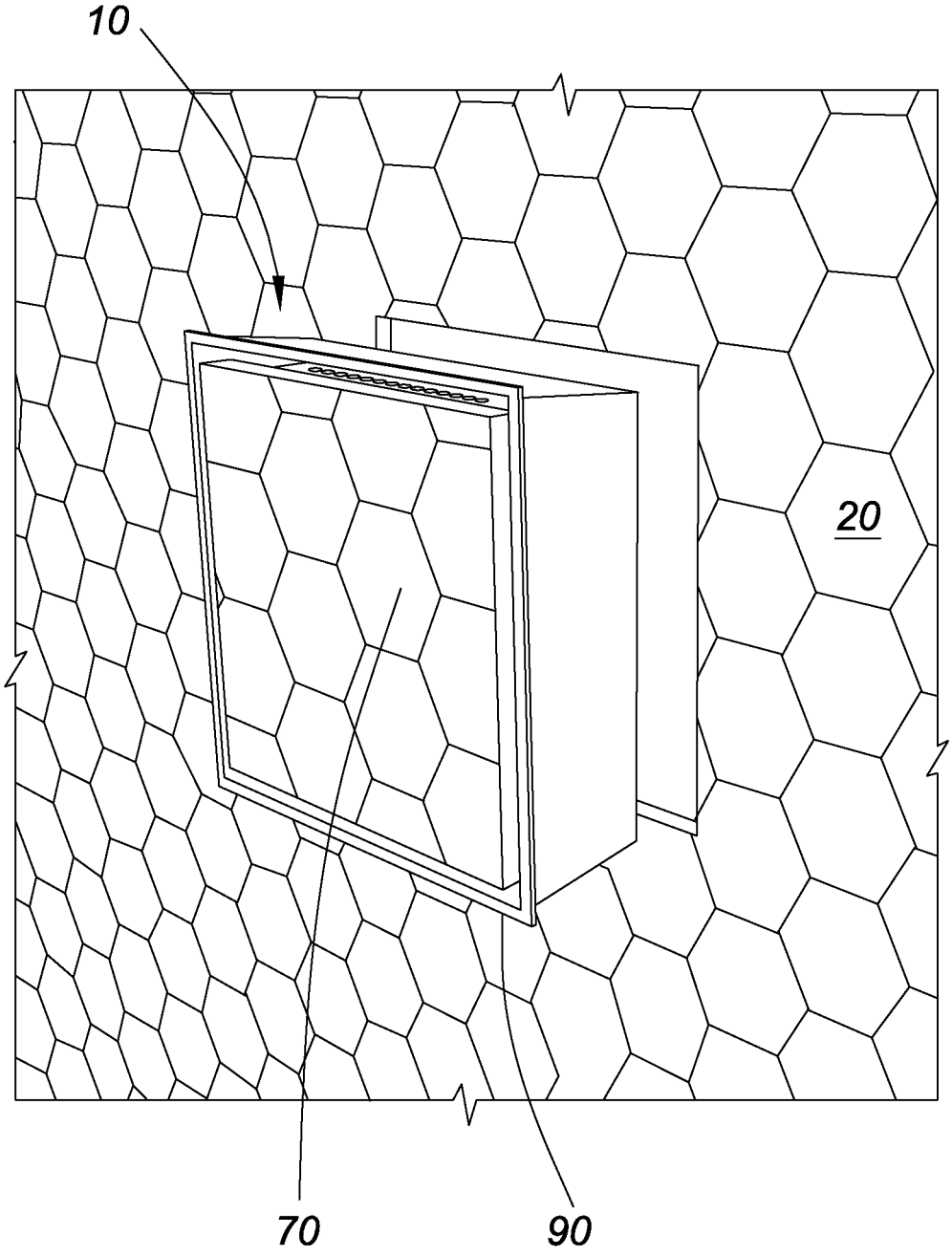
FIG. 5 is another perspective view with partial exploded view of the nestable and drainable niche insert associated with a stall wall.
Figure 6:
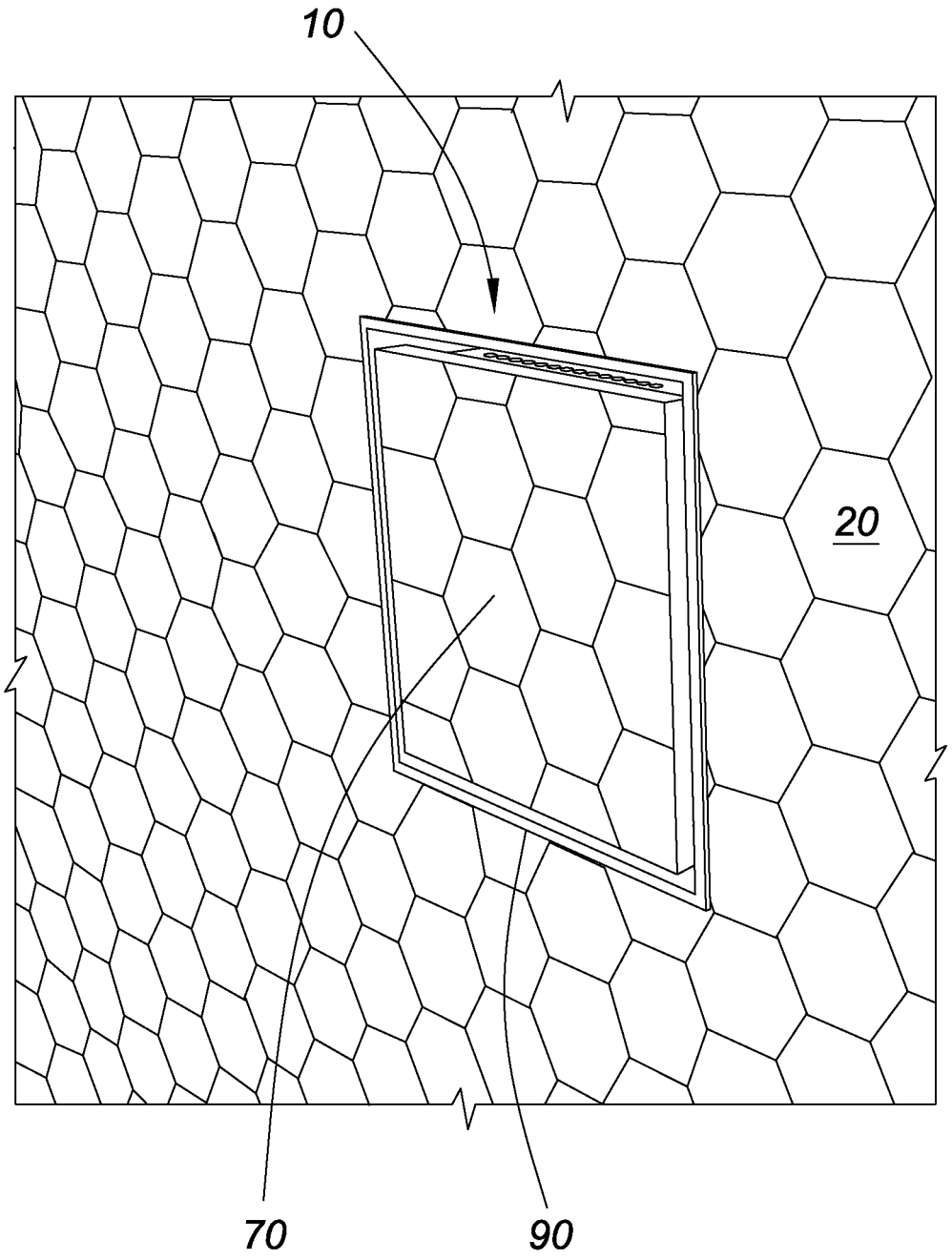
FIG. 6 is another perspective view of the nestable and drainable niche insert inserted into and lying co-planar with a stall wall.

A swinging door (70) can be added using conventional male-female cooperative engagements (for example pin/male (100) and hole/female (110) as best seen in FIG. 4) to hing a swinging door (70) to the nest pan (40) so that the door (70) can swing between a closed position wherein the door (70) is nested within the water-tight pan (30) to an open position such that items on the shelf (60) can be easily accessed.

The swinging door (70) can vary in configuration in that it is largely immaterial whether the door (70) is hinged to the water-tight pan (30) or the nest pan (40) or conceivably even both.

As long as the swinging door (70) functions to nest within the water-tight pan (30), the door (70) will adequately serve its function to conceal the insert system (10) shelf (60) contents (not shown).

Still more preferable is to have the door (70) configured such that a central portion of the door (70) is itself relatively countersunk to define a compartment for receiving and retaining a decorative tile therein.

The decorative tile can be permanently affixed within the swinging door (70) using standard water-resistant epoxies and the like.

Ideally the decorative tile will mimic or be identical to tiling already existing in the shower stall (20) such that when the door (70) is closed, the niche insert system (10) appears nearly invisible (or otherwise contiguous) within the shower stall (20) and any items on the shelf (60) are no longer outwardly visible to an outside observer.

The door (70) is preferably sized so that the door (70) is nested within the water tight pan (30) to define a circumscribing gap therearound and between the swinging door (70) and the water-tight pan (30), for air and liquid to flow freely from outside the swinging door (70) when in the closed position to inside and around the nest (40) and water-tight pan (30) and back to the outside (meaning exiting into the stall (20)).

For convenience in installation, it is also preferable the niche insert system (10) define a circumscribing lip (90) atop the water-tight pan walls for retaining and sealing against the shower stall (20).

I claim:

1. A nestable and drainable shower niche insert system for inserting vertically and retaining within a shower stall, the system comprising:

a water-tight pan to insert and retain within and against the shower stall, the water-tight pan having outwardly sloped walls for gravitational liquid drainage downward and away from the water-tight pan into the shower stall; and a nest pan having four walls arranged in a quadrilateral configuration, at least one wall of the four walls being horizontal to ground level for resting selected items thereupon, the horizontal wall being adjacent one of the outwardly sloped walls, to guide and drain liquid running off the horizontal wall away from both the nest pan and water-tight pan into the shower stall, the nest pan retained and nested within the water-tight pan and countersunk relative to the water-tight pan to define a circumscribing gap therearound and between the water-tight pan and the four walls of the nest pan for drainage and airflow; and a swinging door hinged to the nest pan, wherein the swinging door is moveable between an open position allowing access to the selected items in the nest pan and a closed position where the swinging door is nested within the water-tight pan.

2. The nestable and drainable shower niche insert system in claim 1, wherein the swinging door defines a countersunk insert panel for receiving and retaining decorative tile therein.

3. The nestable and drainable shower niche insert system in claim 1, wherein the swinging door is sized and nested within the watertight pan to define a circumscribing gap therearound and between the swinging door and the watertight pan, for air and liquid to flow freely from outside the swinging door when in the closed position to inside and around the nest and watertight pan and back to the outside.

4. The nestable and drainable shower niche insert system in claim 1, wherein the at least one nest pan wall horizontal to ground level defines multiple openings for liquid passage therethrough to one of the water-tight pan outwardly sloping walls for gravitational liquid drainage.

5. The nestable and drainable shower niche insert system in claim 1, wherein the water-tight pan is comprised of a circumscribing lip atop the water-tight pan walls for retaining and sealing against the shower stall.

6. The nestable and drainable shower niche insert system in claim 1, wherein the water tight pan is quadrilateral.

7. The nestable and drainable shower niche insert system in claim 1, wherein the nest pan is quadrilateral.

* * * * *